US009200870B1

(12) United States Patent
Theel

(10) Patent No.: US 9,200,870 B1
(45) Date of Patent: Dec. 1, 2015

(54) VIRTUAL ENVIRONMENT HUNTING SYSTEMS AND METHODS

(76) Inventor: Travis B. Theel, Lenexa, KS (US)

( * ) Notice: Subject to any disclaimer, the term of this patent is extended or adjusted under 35 U.S.C. 154(b) by 467 days.

(21) Appl. No.: 13/489,768

(22) Filed: Jun. 6, 2012

Related U.S. Application Data

(60) Provisional application No. 61/520,201, filed on Jun. 6, 2011.

(51) Int. Cl.
*F41G 3/26* (2006.01)
*F41A 33/00* (2006.01)
*A63F 9/02* (2006.01)

(52) U.S. Cl.
CPC ... *F41G 3/26* (2013.01); *A63F 9/02* (2013.01); *A63F 9/0252* (2013.01); *F41A 33/00* (2013.01)

(58) Field of Classification Search
CPC ..... F41A 33/00; F41G 3/26; A63F 9/0252; A63F 9/02
USPC ..... 434/11, 19, 21, 16, 20; 463/49
See application file for complete search history.

(56) References Cited

U.S. PATENT DOCUMENTS 1,477,638 A * 12/1923 Feigenbaum ..... 110/217
2,356,768 A * 8/1944 Ladon ..... 52/82
2,406,574 A 8/1946 Waller
2,413,243 A * 12/1946 Neff ..... 52/81.4
2,795,057 A * 6/1957 Sohn ..... 434/19
3,588,237 A * 6/1971 Aldrich ..... 52/39
3,999,337 A * 12/1976 Tomassetti et al. ..... 52/82
4,282,453 A 8/1981 Knight et al.
4,304,406 A * 12/1981 Cromarty ..... 473/225
4,392,652 A * 7/1983 Knight et al. ..... 273/358
4,488,392 A * 12/1984 Pearcey et al. ..... 52/741.11
4,514,621 A 4/1985 Knight et al.
4,538,991 A * 9/1985 Simpson et al. ..... 434/12
4,573,924 A * 3/1986 Nordberg ..... 434/20
4,655,193 A * 4/1987 Blacket ..... 126/224
4,657,511 A 4/1987 Allard et al.
4,662,137 A * 5/1987 Edgar et al. ..... 52/245
5,313,763 A * 5/1994 Oram ..... 52/80.2
5,641,288 A 6/1997 Zaenglein, Jr.
6,805,663 B1 * 10/2004 Bugliosi et al. ..... 600/38
6,840,772 B1 1/2005 Pura
2005/0275813 A1 * 12/2005 Yamazaki ..... 353/94
2006/0063574 A1 * 3/2006 Richardson et al. ..... 463/1
2006/0107985 A1 * 5/2006 Sovine ..... 135/96
2007/0015116 A1 * 1/2007 Coleman ..... 434/16
2009/0286208 A1 * 11/2009 Coleman ..... 434/20
2013/0272474 A1 * 10/2013 Conway et al. ..... 376/299

OTHER PUBLICATIONS

Jauhari, Mohan, "Bullet Ricochet From Metal Plates," Journal of Criminal Law and Criminology, vol. 60, Issue, 3. 1970.*

* cited by examiner

*Primary Examiner* — Michael Grant
(74) *Attorney, Agent, or Firm* — Lathrop & Gage

(57) ABSTRACT

One virtual environment hunting system includes a platform, a wall surrounding the platform, a projector system configured to apply images to the wall, and at least one processor. The wall is separated from the platform by a floor, defines an opening above the platform, and is configured such that all bullets fired to the wall from a shooter on the platform reflect into the floor. Programming causes the processor to: (a) actuate the projector system to apply images to the wall to represent an environment; (b) determine a trajectory of a fired bullet using data from at least one housing sensor and at least one shooter sensor; (c) determine how the trajectory of the fired bullets interacts with the represented environment; and (d) actuate the projector system to update the images applied to the wall to account for the trajectory of the fired bullets.

16 Claims, 5 Drawing Sheets

VIRTUAL ENVIRONMENT HUNTING SYSTEMS AND METHODS

CROSS-REFERENCE TO RELATED APPLICATIONS

This application claims priority to U.S. Patent Application No. 61/520,201, filed Jun. 6, 2011, which is incorporated herein by reference in its entirety.

BACKGROUND

People regularly hunt birds, animals, and even other people (e.g., fugitives or enemies) using firearms. Firearms are typically, though clearly not always, used outdoors and are by their very nature dangerous. As such, proper training for firearm use is often emphasized.

Currently, firearm training that uses live fire often occurs at local firing ranges where physical targets are displayed and fired upon in designated, linear areas. Hunting, on the other hand, generally involves traveling to locations having sought prey, and often requires one or more licenses. While some prior art systems use lasers or other non-live fire for training purposes, such systems may fail to provide an accurate experience that fully simulates (or prepares the user for) live fire.

SUMMARY

Virtual environment hunting systems and methods are provided. According to one embodiment, a virtual environment hunting system includes a platform, at least one wall surrounding the platform, at least one projector, at least one housing sensor, at least one shooter sensor, and at least one processor. The at least one wall is separated from the platform by a floor, defines an opening above the platform, and is configured such that all bullets fired to the at least one wall from a shooter on the platform reflect into the floor. The at least one projector is configured to apply images to the at least one wall. The processor is in data communication with the at least one projector, the at least one housing sensor, the at least one shooter sensor, and programming. The programming causing the processor to: (a) actuate the at least one projector to apply images to the at least one wall to represent an environment, the images including a visual representation of prey; (b) determine a trajectory of a fired bullet using data from the at least one housing sensor and the at least one shooter sensor; (c) determine how the trajectory of the fired bullets interacts with the represented environment; and (d) actuate the at least one projector to update the images applied to the at least one wall to account for the trajectory of the fired bullets.

According to another embodiment, a virtual environment hunting system includes a first area having a first platform and at least one wall surrounding the first platform. The at least one wall is separated from the first platform by a first floor, defines an opening above the first platform, and is configured such that all bullets fired to the at least one wall from a shooter on the first platform reflect into the first floor.

BRIEF DESCRIPTION OF THE DRAWINGS

Illustrative embodiments of the present invention are described in detail below with reference to the attached drawings.

DETAILED DESCRIPTION

Figure 1:
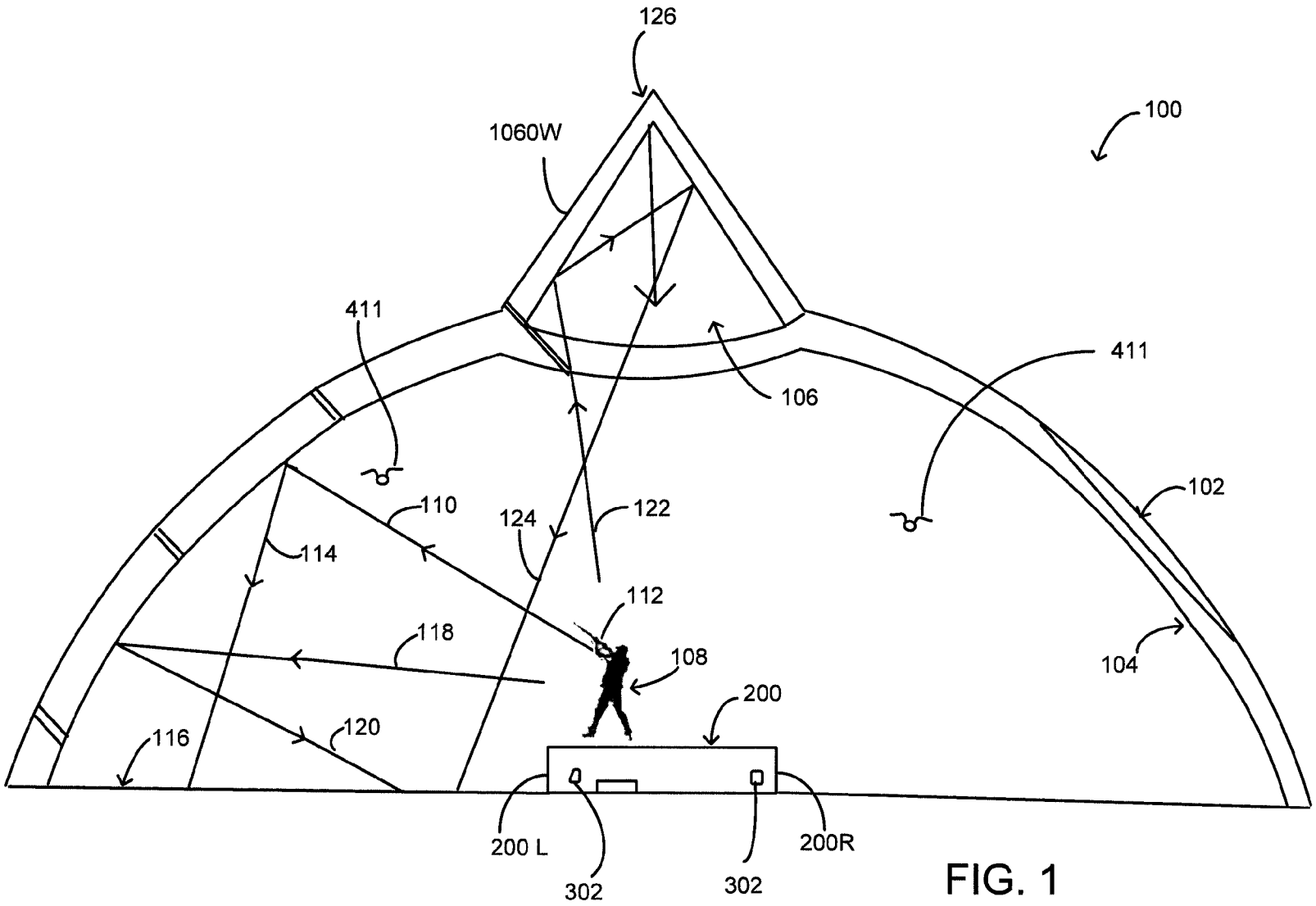
FIG. 1 is a sectional view of a virtual environment hunting system according to one embodiment, in use.

Firearms have become a common household item, and it is estimated that over seventy million people in the United States alone own at least one firearm. Firearms may be used for a variety of purposes. For example, people may use firearms to defend their homes and workplaces (e.g., shops or banks) against invaders, to hunt animals, to defend against enemies in wars, or for mere recreation.

To improve their shooting accuracy, firearm owners often practice their shooting at firing ranges. One type of firing range generally comprises an enclosed area that is divided into multiple linear shooting lanes. Each shooting lane may include a pulley (or other comparable) system that allows the shooter to set up a target paper within the lane at a desirable distance. The shooter may set up the target paper at the desired distance, shoot at the target paper, and then reel the target paper back towards him to analyze the accuracy of his shots.

This type of a firing range, however, has several drawbacks. Consider, for example, a bird (e.g., pheasant) hunter who uses a conventional firing range to improve his bird hunting skills. In practice, the bird hunter may encounter target birds flying in all directions. The firing range, however, may only allow the bird hunter to practice his shots in a linear direction. Moreover, the target paper may not be shaped like a bird, and the stationery target paper may not prepare the bird hunter to shoot at flying targets. Additionally, the overall ambiance and environment of the firing range may fail to emulate an actual hunting environment (e.g., a forest or hunting ground).

Another type of firing range is less confined and launches clay targets as targets for shooters. Those firing ranges may require a relatively large amount of space, and the movement of the clay targets may fail to accurately depict the flight of a bird.

Because of these drawbacks, the bird hunter may prefer to practice shooting at birds on an actual hunting ground instead of a firing range. This too, however, has its drawbacks. For example, if a bird hunter shoots at a live bird and misses, he may not get any feedback to help him correct his mistake (e.g., the bird hunter may not know whether his shot was too high, or too much to the left, et cetera). Furthermore, shooting on the hunting ground may require costly licenses, and the hunting ground may only be open during particular seasons and not allow the hunter to practice his shooting year round.

Virtual shooting ranges may solve some of these problems. Virtual shooting ranges, akin to certain shooting video games available on the market today, may display targets on a screen and allow a user to shoot at these targets with a dummy gun that emits, for example, infrared signals or lasers. Such virtual shooting ranges, however, have their own drawbacks; the most noticeable of which is that they do not simulate live fire. Those who have fired firearms will appreciate that the experience of firing a live gun, because of gun recoil and other such factors (e.g., loading and reloading, gun heft and feel, et cetera), cannot be accurately replicated with dummy guns.

Attention is now directed to FIG. 1, which shows a cross sectional view of a virtual environment hunting system 100 in accordance with one embodiment of the current invention. The hunting system 100 comprises a housing or shooting area 102 which generally surrounds a platform 200. As discussed in more detail below, a user may shoot live rounds at the housing 102 while standing (or sitting, kneeling, et cetera) on the platform 200.

As people of skill in the art will appreciate, shooting live rounds in an enclosed space presents serious safety concerns. Specifically, a bullet from a firearm (such as a rifle, hand gun, etc.), once it hits a surface of an enclosed space, may ricochet and injure (or even kill) the shooter or others in the vicinity. The housing 102 may be designed to prevent such unintended consequences. While the system 100 is generally described in use with "bullets", it should be understood that the term "bullet" is used herein both to refer to a single projectile such as that fired from a rifle as well as pellets (or "shot") such as those fired from a shotgun.

To prevent such unintended consequences, the housing 102 may generally be dome shaped and have a curved portion 104 and a top portion 106 as shown in FIG. 1. The curved portion 104 may be configured to ensure that a bullet fired by a shooter on the platform 200 does not ricochet back to the platform 200, irrespective of where it strikes the curved portion 104, and irrespective of the position of the shooter on the platform 200. More specifically, a shooter 108 may shoot at the curved portion 104 a bullet having an angled trajectory 110 from a rifle 112 while standing towards a side 200L of the platform 200; as can be seen, the bullet, because of the arced shape of the curved portion 104, may be reflected along a trajectory 114 into the ground 116 (away from the platform 200). Similarly, the shooter 108 may kneel and shoot at the curved portion 104 a bullet having generally horizontal trajectory 118; this bullet too, because of the arced shape of the curved portion 104, may be reflected along a trajectory 120 into the ground 116. While the trajectories 110, 118 of two bullets are shown in FIG. 1, people of skill in the art will appreciate that any bullet shot by the shooter 108 at the curved portion 104, as he stands, sits, kneels, et cetera on the platform 200 (regardless of whether the shooter 108 is located at the side 200L, a side 200R, or anywhere else on the platform 200), may ricochet into the ground 116 and not contact the platform 200. The ground 116 may be configured to ensure that the bullets will not ricochet off it; for example, the ground 116 may comprise loose dirt and be capable of absorbing hundreds of bullets. From time to time, the bullets and shells on the ground 116 may be removed (e.g., by replacing the loose dirt on the ground 116).

To ensure that a bullet shot generally vertically by the shooter 108 does not reflect back towards the platform 200, the top portion 106 may have various configurations. In one embodiment, the top portion 106 is shaped like a cone and have angled walls 106W. The angled walls 106W may be tilted so as to deflect any bullet away from the platform 200. For example, a bullet fired at the top portion 106 along trajectory 122 may be deflected towards the ground 116 along trajectory 124 after hitting the angled walls 106W more than once. It will be appreciated that a bullet fired at an edge 126 of the top portion 106 may deflect straight back towards the platform 200, as this bullet may not contact the angled walls 106W. The edge 126 may thus be constructed of materials configured to absorb and retain bullets (e.g., shock absorbing concrete such as SACON®, or other suitable materials). In other embodiments, the top 126 may be offset from above a center point of the platform 200. And in still other embodiments, much or all of the walls 106W may be configured to absorb and retain bullets.

Thus, as has been described, the shooter 108 may stand (or walk around, sit, kneel, lie down, et cetera) on the platform 200 and shoot live rounds anywhere at the housing 102 indiscriminately without risking injury from ricocheting bullets. People of skill in the art will appreciate that the platform 200 may be circular or any other desirable shape (e.g., rectangular, triangular, octagonal, et cetera).

Figure 2:
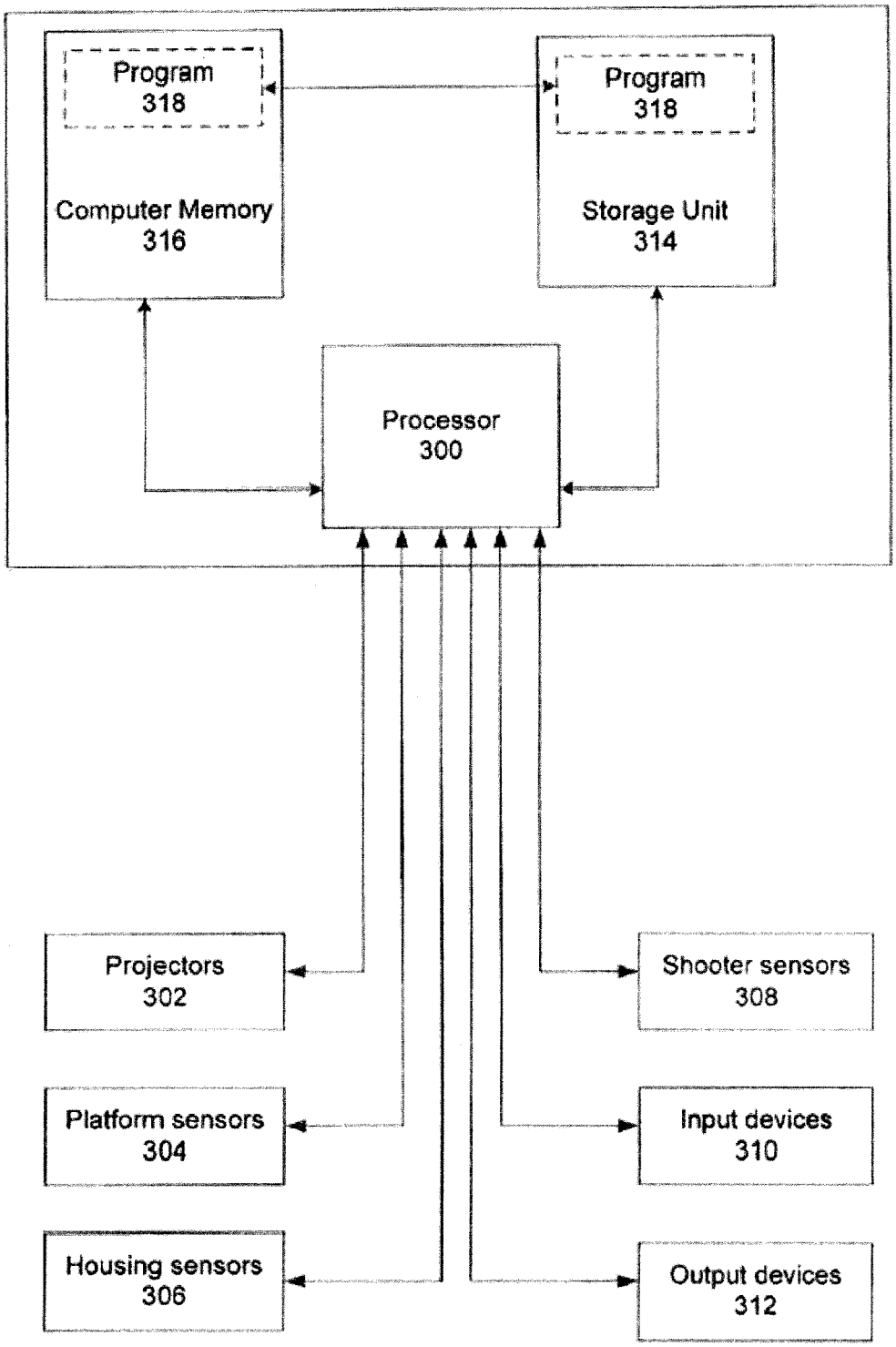
FIG. 2 is a block diagram showing certain components of the system of FIG. 1.

Attention is now directed to FIG. 2. The hunting system 100 may be interactive, and may include a processor or controller 300 that is in data communication with projectors 302, platform sensors 304, housing sensors 306, shooter sensors 308, input devices 310, and output devices 312. The hunting system 100 may also include a storage unit 314 and a computer memory 316 in data communication with the processor 300. The storage unit 314 may be, for example, a disk drive that stores programs and data, and the storage unit 314 is illustratively shown storing a program 318 embodying the steps and methods set forth below. It should be understood that the program 318 could be broken into subprograms and stored in storage units of separate computers and that data could be transferred between those storage units using methods known in the art. A dashed outline within the computer memory 316 represents the software program 318 loaded into the computer memory 316, and a dashed line between the storage unit 314 and the computer memory 316 illustrates the transfer of the program 318 between the storage unit 314 and the computer memory 316. The processor 300, the storage unit 314, and the computer memory 316 may be placed within the housing 102 (e.g., underneath the platform 200) or may be external to the housing 102.

The projectors 302 may be any appropriate type of projectors, for example, HD projectors, LCD projectors, DLP projectors, CRT projectors, et cetera. The projectors 302 may be placed underneath the platform 200 (FIG. 1) and/or on the sides 200L, 200R of the platform 200. The projectors 302 may also be placed within the top portion 106 or the curved portion 104 of the housing 102. When the projectors 302 are placed within the top portion 106 or the curved portion 104, protective coverings may be provided to shield the projectors 302 from damage by bullets and ensure proper deflection of bullets.

The projectors 302 may be configured to project videos onto the curved portion 104 and the angled walls 106W. In some embodiments, the videos may be projected by the projectors 302 on part of the curved portion 104 and/or the angled walls 106W to create a virtual environment. Alternatively, the videos may be projected by the projectors 302 in continuous fashion on the entire curved portion 104 and/or the angled walls 106W to generate a virtual environment that surrounds the shooter 108 standing on the platform 200 on all sides. The projectors 302 may also display still images. In some embodiments, the projectors 302 may be 3D projectors that are configured to display 3D images and videos on the curved portion 104 and/or the angled walls 106W.

The platform 200 may include one or more of the platform sensors 304, which may be, for example, weight sensors or relays that are configured to determine whether or not the shooter 108 is standing on the platform 200. Where multiple platform sensors 304 are provided, the platform sensors 304 may also be used to determine the location of the shooter 108 on the platform 200 (e.g., shooter 108 is standing towards the side 200L of the platform 200). The platform sensors 304 may also act as part of a kill switch. More specifically, as discussed in more detail below, the processor 300 may be configured to immediately shut down the projectors 302 and terminate the program 318 as soon as the shooter 108 steps off the platform 200.

Figure 3:
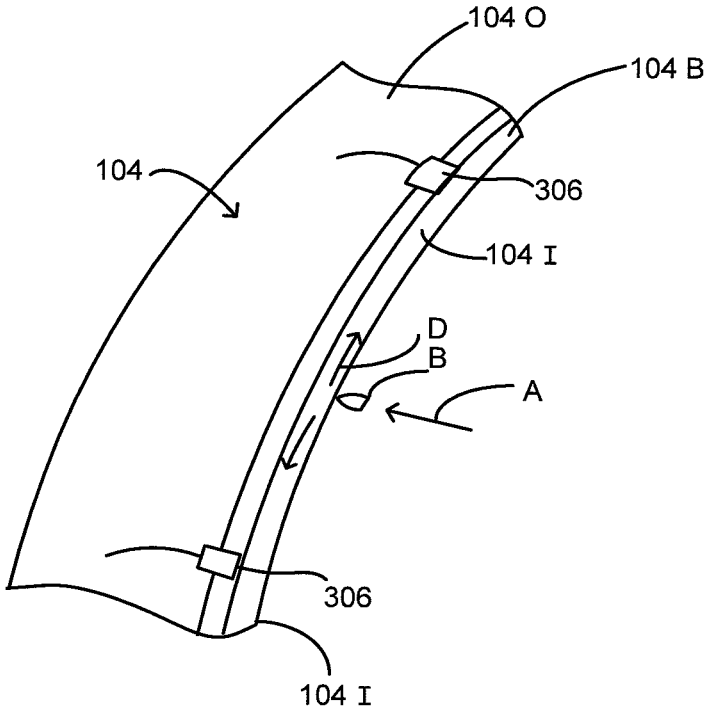
FIG. 3 is a section view of a part of a wall of the system of FIG. 1.

The housing sensors 306 may be any type of sensors that can detect that a bullet has impacted the housing 102. In the preferred embodiment, the housing sensors 306 may be configured to detect vibrations (for example, the housing sensors 306 may be piezoelectric accelerometers). As shown in FIG. 3, the curved portion 104 of the housing 102 may include an inner wall 1041, an intermediate wall 104B backing the inner wall 1041, and an outer wall 1040. The inner wall 1041 of the curved portion 104 may be metallic, and in conjunction with the intermediate wall 104B and the outer wall 1040, may be configured to deflect bullets towards the ground 116. Multiple housing sensors 306 may be secured at known intervals to the intermediate wall 104B. These housing sensors 306 may also be in contact with the inner wall 1041. A shooter 108 standing on the platform 200 may shoot a bullet B having a trajectory A at the inner wall 1041, which may cause vibrations to flow along the inner wall 1041 in direction D. The housing sensors 306 may be configured to evaluate these vibrations to enable the processor 300 to quantify the point of impact of the bullet B on the inner wall 1041.

Specifically, as will be appreciated, the vibrations from the bullet B will reach different housing sensors 306 at different times depending on the proximity of the housing sensors 306 to the point of impact (i.e., a housing sensor 306 that is closer to the point of impact of the bullet B on the inner wall 1041 may detect these vibrations before a housing sensor 306 that is further away from the point of impact.) Based on the different times at which these vibrations are detected by the various housing sensors 306, and the known distances between the various housing sensors 306, the processor 300 may triangulate the point of impact of the bullet B on the inner wall 1041 with precision. The top portion 106 of the housing 102 may similarly include housing sensors 306 to determine the point of impact of a bullet that strikes the angled walls 106W. In other embodiments, the sensors 306 may for example include audio and/or optical sensors.

Additional information may be provided to the processor 300 by the shooter sensors 308. The shooter sensors 308 may be configured to determine or approximate the location of the firearm 112 when the bullet B is fired by the shooter 108. By way of example, the shooter sensors 308 may be optical or audio position sensors that have an emitting element and sensing elements. The emitting element may for example be adhered to the firearm 112 (e.g., on the scope of a rifle or the butt of a handgun) or incorporated into the apparel of the shooter 108 (e.g., on a shooter's earmuffs or helmet). The corresponding sensing elements may reside within the platform 200 or the housing 102. The emitting element may emit, for example, laser beams or radio frequency waves that are sensed by the sensing elements. The processor 300, based for example on the time that elapses between the emissions by the emitting element and the sensing by the sensing element, the known speed of the emissions, and the strength of the received signal, may triangulate or otherwise determine the location of the firearm 112 at the time the bullet B was fired by the shooter 108. From this information, the processor 300 may ascertain whether the shooter 108 was kneeling on the platform 200 as he fired the bullet B, or whether the shooter 108 was standing up or lying down, et cetera while firing. Where the platform sensors 304 are configured to determine the position of the shooter 108 on the platform 200, the processor 300 may nevertheless triangulate the position of the shooter 108 on the platform 200 using the shooter sensors 308 to verify (or determine with improved accuracy) the position of the shooter 108—and particularly the firearm 112. People of skill in the art will appreciate that the number of sensing elements and emitting elements of the shooter sensors 308 need not be equal, and that positioning of the sensing elements and emitting elements may be reversed.

The input devices 310 may include, for example, a keyboard, a mouse, a microphone, et cetera. The input devices 310 may be wired to the processor 300 or may be configured to communicate with the processor 300 wirelessly (e.g., over a wireless internet or intranet network). As discussed in more detail below, the input devices 310 may allow an administrator or user of the virtual hunting system 100 to access, configure, and tailor the program 318 to meet the specific requirements of the user. The output devices 312 may include, for example, printers, speakers, video and/or audio recorders, et cetera.

Figure 4:
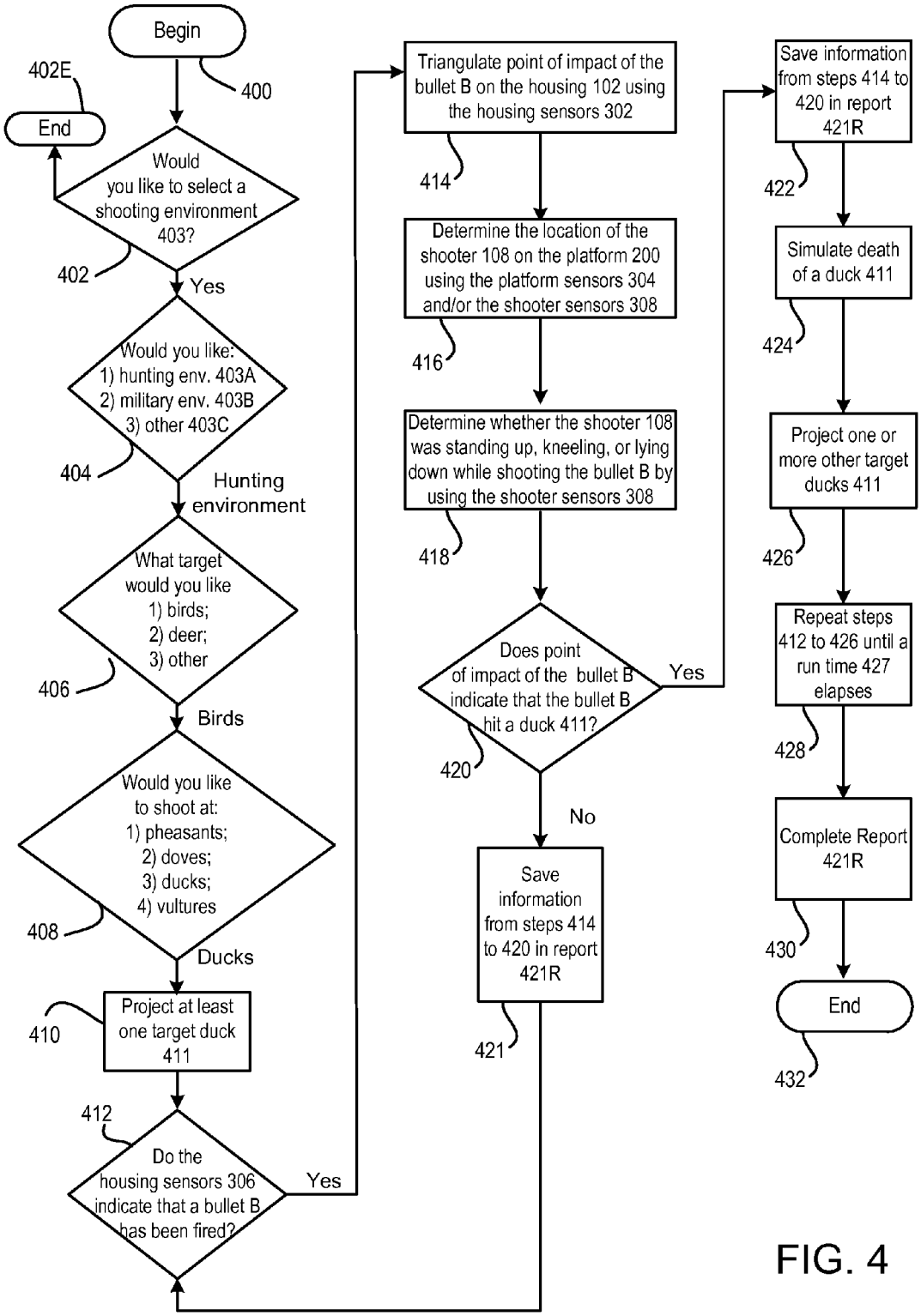
FIG. 4 is a flow chart showing an exemplary set of steps performed by the system of FIG. 1.

Attention is now directed to FIG. 4, which shows example steps performed by the processor 300 in accordance with the program 318 according to one embodiment. The program 318 begins at step 400, and at step 402 asks the shooter 108 whether he would like to select a shooting environment 403. This inquiry (and the remaining inquiries) may for example be displayed by the projectors 302 for the shooter 108 on the inner wall 1041 of the curved portion 104. The shooter 108 may respond to the inquiries by using one or more of the input devices 310. If the shooter 108 conveys that he does not want to select a shooting environment 403, the program 318 may end at step 402E (or alternatively, randomly select a shooting environment 403 for the shooter 108). If, on the other hand, the shooter 108 answers at step 402 that he would like to select a shooting environment 403, at step 404, the program 318 may cause the projectors 302 to display various available shooting environments 403. By way of example, these shooting environments 403 may include a hunting environment 403A and a military environment 403B.

The hunting environment 403A may be configured to emulate hunting experiences. For example, selection of the hunting environment 403A may cause the projectors 302 to display onto the inner wall 1041 of the curved portion 104 and the angled walls 106W of the top portion 106 a forest as it appears during the day time, a hunting ground as it appears at dusk, a wooded area with a water body as it appears in the evening, et cetera. The military environment 403B may be configured to emulate militaristic scenarios. For example, if the shooter 108 chooses the military environment 403B, the projectors may simulate residential areas with tanks and other military vehicles and weapons, et cetera. It will be appreciated that the hunting environment 403A and the military environment 403B are exemplary only and that various other environments 403C may be provided (e.g., a futuristic environment depicting robots and space vehicles, a medieval environment with knights on horses, an environment simulating a burglary, an environment simulating a kidnapping, et cetera).

The shooting environments 403 may be customized further to meet the unique requirements of the shooter 108. For example, if the shooter 108 chooses the hunting environment 403A at step 404, then at step 406 the program 318 may inquire whether the shooter 108 wishes to shoot at birds, deer, or other animals. Similarly, if the shooter 108 had chosen a military environment 403B, the program 318 could have inquired at step 406, for example, whether the shooter 108 wishes to emulate the Cold War, World War I or II, the Iraqi invasion, et cetera.

Assume that the shooter 108 chooses birds at step 406. At step 408, then, the program 318 may provide the shooter 108 with different types of birds to choose from (e.g., pheasants, doves, ducks, et cetera). If the shooter 108 had chosen the military environment 403B at step 404 and the Iraqi invasion at step 406, for example, then at step 408, the program 318 may have inquired whether the shooter 108 wishes to practice his shooting in a crowded or uncongested area. For purposes of illustration, ducks 411 have been chosen at step 408 in FIG. 4.

Steps 402, 404, 406, 408 in the embodiment of FIG. 4 may be collectively thought of as setup or user input steps. Those skilled in the art will appreciate that some (or even all) of those steps may be combined together or omitted, and that additional setup steps may be included. For example, the type of firearm 112 and ammunition and/or a duration (e.g., one hundred targets, one hundred shots, a time limit, etc.) may be selected.

At step 410, the program 318 may cause the projectors 302 to project onto the internal wall 1041 and/or the angled walls 106W one or more target ducks 411 (see FIG. 1). The ducks 411 may be displayed as being at rest or in flight, and the ducks 411 may be blended in with the hunting environment 403A (e.g., the ducks 411 may be shown as resting in a pond) which may remain stationary or which may constantly change to simulate wind, cloud cover, or other environmental factors. At the same time, the program 318 may cause the speakers 312 to provide audio inside the housing 102 to further simulate the hunting environment and prey.

After causing the projectors 302 to display the target ducks 411, the processor 300 may poll the housing sensors 306 to determine whether the bullet B has been fired by the shooter 108. If the housing sensors 306 indicate that the bullet B has been fired (i.e., if some or all of the housing sensors 306 detect significant vibrations), then at step 414 the program 318 may determine the point of impact of the bullet B on the internal wall 1041 and/or the angled walls 106W (e.g., through triangulation). As discussed above, the processor 300 may quantify the point of impact of the bullet B by using the difference in the times at which the vibrations caused by the bullet B are detected by the various sensors 306, and the known distance between these sensors 306.

At step 416, the processor 300 may determine the location of the shooter 108 on the platform 200—and specifically the location of the firearm 112—at the time the bullet B was fired by using the platform sensors 304 and/or the shooter sensors 308. At step 418, as discussed above, the processor 300 may also determine whether the shooter 108 was standing up, kneeling, lying down, et cetera while shooting the bullet B by using the shooter sensors 308.

At step 420, the processor 300 may determine whether the bullet B struck any of the target ducks 411. Specifically, the processor 300 may keep track of the location of the projected target ducks 411 on the inner wall 1041 and/or the angled walls 106W at all times. The processor 300 may also determine the time of impact of the bullet B by using the housing sensors 306, and may determine the trajectory of the bullet B using the firing location, the point of impact, and information about the firearm 112 and the bullet B such as orientation of the firearm 112 (which may be provided by a gyroscope attached to the firearm 112, through analyzing visual data captured by the video recorder 312, etc.), velocity of the bullet B upon firing, the shape of the bullet B, et cetera. The processor 300 may then compare the location of the target ducks 411 to the trajectory of the bullet B and determine whether the bullet B struck any of the target ducks 411.

If the bullet B did not strike a target duck 411, then at step 421 the processor 318 may save the information from steps 414 to 420 in a report 421R and loop back to step 412 to wait for the next bullet B. If, on the other hand, the processor 300 determines that the bullet B struck a duck 411, the processor 300 may save the information from steps 414 to 420 in the report 421R at step 422 and simulate death of the duck 411 at step 424. For example, the processor 300 may cause the projectors 302 to display the duck 411 falling down from flight onto the ground. Next, at step 426, the processor 300 may project one or more other target ducks 411, and according to step 428, repeat steps 412 to 426 until a run time 427 elapses. Steps 412, 414, 416, 418, 420, 421, 422, 424, 426 may be repeated very quickly to analyze shots fired in quick succession (or generally simultaneously, such as with shotgun shot).

The run time 427 may be, for example, a fixed length of time such as ten minutes, twenty minutes, an hour, et cetera. Alternatively, the run time 427 may be performance based; for example, the run time 427 may elapse when the shooter 108 successfully shoots down (or misses) ten target ducks 411, twenty target ducks 411, et cetera. After the run time 427 elapses, the processor 300 may finalize the report 421R. The program 318 may then end at step 432.

Those skilled in the art will appreciate that various described steps may occur in different orders, and that steps may be omitted or added. For example, in some embodiments, step 416 and step 418 may occur before step 414; or step 418 may be omitted.

The report 421R may be, for example, computer printouts that outline the performance of the shooter 108. For example, the report 421R may include the number of target ducks 411 that the shooter 108 was able to shoot successfully, and the number of bullets B that were off-target. In the case of shotgun shot, the number of off-target shots taken (instead of the number of bullets B) may be provided. In addition, the report 421R may include, for example, the number of ducks 411 that the shooter 108 was able to shoot in the head or body, as opposed to the wing. The report 421R may also include suggestions for the shooter 108. For example, the report 421R may outline that the shooter 108 is generally off-target towards the left and that the he should aim further towards the right. Or, for example, the report 421R may convey that the shooter 108 was kneeling when he should have been standing up, or that the shooter 108 should have moved to the left 200L of the platform 200 to get a clear line of sight to shoot a duck 411 that was otherwise obstructed by a tree. The report 421R may also include a video and audio recording of the shooter's experience with the virtual hunting system 100, captured by the output device(s) 312. The shooter 108 may utilize the video and the instructional feedback in the report 421R to improve his shooting.

In some embodiments, the program 318 may allow the shooter 108 to shoot at the target ducks 411 with different types of firearms and ammunition. For example, shooter 411 may shoot at the first ten target ducks 411 with a twelve gauge shotgun 112, and at the next ten target ducks 411 with a twenty gauge shotgun 112. For different types of prey, a rifle 112, a nine mm handgun 112, a .38 caliber pistol 112, etc. may be used. As people of skill in the art will appreciate, parameters of the calculations performed by the processor 300 may vary based on the type of firearm and ammunition; for example, the duration between firing and impact on the housing 102 may be different for different types of firearms and ammunition. Similarly, the vibrations sensed by the housing sensors 306 may be different for different firearms (e.g., the housing sensors 306 may sense greater vibrations from a bullet fired by a nine mm handgun than from a bullet fired by a .22 caliber handgun). The program 318 may allow the shooter 108 to input via the input devices 310 the types of firearms 112 and ammunition that the shooter 108 wants to shoot with so that the processor 300 accounts for them in its computations. In some embodiments, the program 318 may allow the shooter 108 to enter these and other preferences into the system 100 by using a firearm instead of the input devices 310 (i.e., the program may display the options and allow the shooter 108 to choose a particular option by shooting at it).

As set forth above, while the system 100 is generally described in use with "bullets", it should be understood that the term "bullet" is used herein both to refer to a single projectile such as that fired from a rifle as well as pellets (or "shot") such as those fired from a shotgun. When a shotgun and shot are used, it may be desirable for the processor 300 to track the travel of all or substantially all of the pellets in the manner discussed above, treating individual pellets in generally the same way that a projectile from a rifle is treated.

The program 318 may also be configured to generate targeted advertisements for the shooter 108 by using the report 421R. For example, if the report 421R indicates that the shooter 108 is unable to consistently hit the chosen target with the rifle 112 but that the shooter 108 is able to consistently hit the chosen target with a 9 mm handgun and a .38 caliber pistol, the report 421R may suggest that the shooter 108 purchase a different rifle 112, a different type of rifle 112, different ammunition for the rifle 112, a scope, et cetera. The program 318 may also include for the shooter 108 coupons and other promotional offers from stores in the area where such items may be purchased. Similarly, if the report 421R indicates that the shooter 108 is unable to consistently shoot the chosen target with any type of firearm, then the report 421R may suggest that the shooter 108 retain a personal trainer and provide to the shooter 108 promotional offers from such personal trainers. An owner (or administrator) of the hunting system 100 may charge the shooter 108 to use the system 100, and/or the targeted advertisements may generate revenue for the owners. Further, the video and audio recording of the experience (captured by the output devices 312) may be made available (e.g., online or through a disc or other media), either for a fee or free of charge, and with or without advertising added.

As discussed above, when the shooter 108 successfully shoots at a target duck 411, at step 424, the program 318 may simulate death of the duck 411 (e.g., display the duck 411 falling down). In some embodiments, the simulation may be more interactive. Consider, for example, that the shooter 108 chooses the military environment 403B as the shooting environment 403. The processor 300 may then cause the projectors 302 to display enemy targets (e.g., enemy soldiers on foot, enemy soldiers in tanks, et cetera). The projected enemy targets may be configured to shoot back at the shooter 108. In this embodiment, the platform 200 may (but need not) include barricades (e.g., barrels, walls, et cetera) which the shooter 108 may use to evade the projected enemy fire. The processor 300 may determine whether the projected enemy fire struck the shooter 108 by evaluating the known trajectories of the enemy fire along with the position and location of the shooter 108 on the platform 200 as ascertained via the platform sensors 304 and the shooter sensors 308. The report 421R may outline whether the shooter 108 was struck by enemy fire, and the steps that the shooter 108 could have taken to better evade the enemy fire.

According to another embodiment, the virtual environment hunting system 100 may include multiple housings 102 that are in data communication with each other. For example, a warehouse or other such structure may include four separate housings 102 to enable four different shooters 108 to simultaneously experience the virtual environment of the hunting system 100. Or the housings 102 may be remote from each other but connected through a network. Each of the housings 102 may display on their inner walls 1041 and the angled walls 106W the same shooting environment 403, either from the same or different vantage points. Consider, for example, that the four shooters 108 choose the hunting environment 403A as the shooting environment 403 and the ducks 411 as targets. Then, a duck 411 that is shot by one of the shooters 108 may be displayed as being shot in all four housings 102. Each of the four shooters 108 may attempt to shoot the ducks 411 before the ducks 411 are shot by the other three shooters 108. The report 421R may include the number of target ducks 411 that each shooter 108 shot successfully, to enable the shooters 108 to compare their performances with each other. The report 421R may also include other information. For example, the report 421R may outline which shooter 108 was most accurate (i.e., had the best ratio of shots fired versus targets 411 struck), or where applicable, which shooter 108 was best able to evade enemy fire. Such versatility may make the hunting system 100 particularly attractive for militaristic applications (e.g., for conducting comparative tests on a large scale). Families and friends may also enjoy interacting with each other via the hunting system 100 in this fashion.

In some embodiments, the shooting environment 403 of the interconnected housings 102 may allow the shooters 108 to shoot at (the projections of) other shooters 108. Consider, for example, a hunting system 100 that includes two housings 102 that are in data communication with each other. The projectors 302 of each housing 102 may display on the inner wall 1041 and the angled walls 106W a target that emulates the shooter 108 in the other housing 102. For example, if a shooter 108 in one housing 108 is kneeling behind a barricade on the platform 200, the target in the other housing 102 may be projected as kneeling behind a barricade. Alternatively, a video of the actual shooter 108 in one housing 102 may be projected in the other housing 102 in real time. The shooters 108 may thus safely shoot at each other (i.e., at the projections of each other) with live rounds.

As noted above, for safety, it is important that the shooters 108 stay on the platforms 200 while shooting, as otherwise, the shooters 108 may be struck unintentionally with ricocheting bullets. The processor 300 may thus be configured to continuously poll the platform sensors 304 to ensure that the shooters 108 are situated on the platform 200. If the platform sensors 304 indicate that a shooter 108 has stepped off the platform 200, even momentarily, the processor 300 may generate an audible warning signal and immediately shut down the program 318, including the projectors 302, and not restart the program 318 until the shooter 108 steps back onto the platform 200. In some embodiments, if a shooter 108 steps off the platform 200, the processor 300 may terminate the program 318 and not restart the program 318 until an administrator of the system 100 follows up with the shooter 108.

Figure 5:
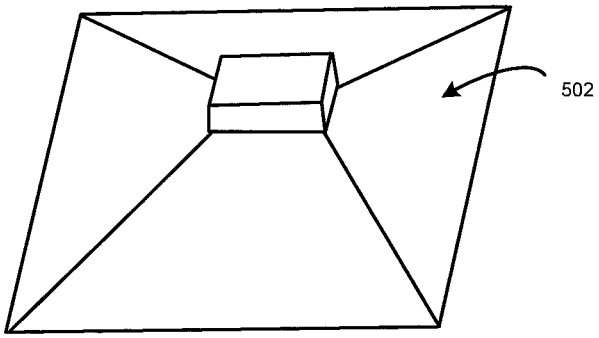
FIG. 5 shows an alternate embodiment of a housing of the system of FIG. 1.

While each housing 102 and platform 200 have been described herein as accommodating a single shooter 108 at a time, it will be appreciated by those skilled in the art that the housing 102 and the platform 200 may be designed to accommodate multiple shooters 108 simultaneously. Additionally, the housing 102 need not be generally dome shaped as shown in FIG. 1. Rather, the housing 102 may take any shape, so long as it is ensured that bullets will not reflect off the walls of the housing 102 onto the platform 200. As shown in FIG. 5, for example, a housing 502 generally shaped as a pyramid may be used for the virtual environment hunting system 100.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. Not all steps listed in the various figures need be carried out in the specific order described.

The invention claimed is:

1. A virtual environment hunting system, comprising:

a platform;

at least one wall surrounding the platform, the at least one wall being separated from the platform by a floor, the at least one wall defining an opening above the platform;

at least one projector configured to apply images to the at least one wall;

at least one housing sensor;

at least one shooter sensor;

a processor in data communication with the at least one projector, the at least one housing sensor, the at least one shooter sensor, and programming; the programming causing the processor to:

(a) actuate the at least one projector to apply images to the at least one wall to represent an environment, the images including a visual representation of prey;

(b) determine a trajectory of a fired bullet using data from the at least one housing sensor and the at least one shooter sensor;

(c) determine how the trajectory of the fired bullet interacts with the represented environment; and (d) actuate the at least one projector to update the images applied to the at least one wall to account for the trajectory of the fired bullet.

2. The virtual environment hunting system of claim 1, further comprising a top portion above the opening for preventing bullets fired into the opening from striking the shooter on the platform.

3. The virtual environment hunting system of claim 2, wherein the top portion includes at least one angled wall for deflecting bullets.

4. The virtual environment hunting system of claim 2, wherein the top portion is constructed of a material for absorbing bullets.

5. The virtual environment hunting system of claim 2, further comprising a sensor for determining whether the shooter is on the platform, and wherein the programming causes the processor to immediately deactivate the at least one projector from applying images to the at least one wall to represent an environment upon determining that the shooter has left the platform.

6. The virtual environment hunting system of claim 5, wherein the at least one wall surrounding the platform is a continuous curved wall.

7. The virtual environment hunting system of claim 6, wherein the platform is raised above the floor.

8. The virtual environment hunting system of claim 7, wherein the images applied to the at least one wall to represent an environment surrounding the platform.

9. The virtual environment hunting system of claim 1, further comprising a sensor for determining whether the shooter is on the platform, and wherein the programming causes the processor to immediately deactivate the at least one projector from applying images to the at least one wall to represent an environment upon determining that the shooter has left the platform.

10. The virtual environment hunting system of claim 1, wherein the at least one wall surrounding the platform is a continuous curved wall.

11. The virtual environment hunting system of claim 1, wherein the platform is raised above the floor.

12. The virtual environment hunting system of claim 1, wherein the images applied to the at least one wall to represent an environment surround the platform.

13. The virtual environment hunting system of claim 1, wherein the at least one projector is housed in the platform.

14. A virtual environment hunting system, comprising:

a first area having:

a first platform;

at least one wall surrounding the first platform and being separated from the first platform by a first floor, the at least one wall defining an opening above the first platform; and at least one first shooter sensor to determine a firing location of a bullet fired from atop the first platform;

a second area distinct from the first area, the second area having:

a second platform; and at least one wall surrounding the second platform and being separated from the second platform by a second floor, the at least one wall defining an opening above the second platform;

a first projector configured to apply images to the at least one wall surrounding the first platform;

a second projector configured to apply images to the at least one wall surrounding the second platform;

at least one first housing sensor to determine an impact location of the bullet fired from atop the first platform;

at least one second housing sensor to determine an impact location of a bullet fired from atop the second platform;

at least one second shooter sensor to determine a firing location of the bullet fired from atop the second platform;

a processor in data communication with the first and second projectors, the at least one first housing sensor, the at least one first shooter sensor, the at least one second housing sensor, the at least one second shooter sensor, and programming; the programming causing the processor to:

(a) actuate the first projector to apply images to the at least one wall surrounding the first platform to represent an environment, the images including a visual representation of prey;

(b) actuate the second projector to apply images to the at least one wall surrounding the second platform to represent the environment, the images including a visual representation of prey;

(c) determine a trajectory of the bullet fired from atop the first platform using the impact location and the firing location of the bullet fired from atop the first platform;

(d) determine a trajectory of the bullet fired from atop the second platform using the impact location and the firing location of the bullet fired from atop the second platform;

(e) determine how the trajectory of the bullet fired from atop the first platform interacts with the represented environment;

(f) determine how the trajectory of the bullet fired from atop the second platform interacts with the represented environment; and (g) actuate the first and second projectors to update the images applied to account for the trajectory of the bullet fired from atop the first platform and the trajectory of the bullet fired from atop the second platform.

15. The virtual environment hunting system of claim 14, wherein the first area and the second area are housed together in a building.

16. The virtual environment hunting system of claim 14, wherein the at least one wall surrounding the first platform is a continuous curved wall.

* * * * *